US010506333B2

(12) United States Patent
Wang

(10) Patent No.: US 10,506,333 B2
(45) Date of Patent: Dec. 10, 2019

(54) ACOUSTIC DEVICE

(71) Applicant: AAC Technologies Pte. Ltd., Singapore (SG)

(72) Inventor: HeZhi Wang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/039,460

(22) Filed: Jul. 19, 2018

(65) Prior Publication Data

US 2018/0352322 A1 Dec. 6, 2018

Related U.S. Application Data

(63) Continuation of application No. 14/729,708, filed on Jun. 3, 2015, now abandoned.

(51) Int. Cl.
*H04R 1/28* (2006.01)

(52) U.S. Cl.
CPC ..... *H04R 1/2876* (2013.01); *H04R 1/2811* (2013.01)

(58) Field of Classification Search
None
See application file for complete search history.

(56) References Cited

U.S. PATENT DOCUMENTS 3,151,966 A * 10/1964 Slayter ..... C03B 19/08 65/22
4,356,882 A * 11/1982 Allen ..... H04R 1/2803 181/151
4,657,108 A * 4/1987 Ward ..... H04R 1/2803 181/149
2003/0015091 A1* 1/2003 Xu ..... B01D 53/047 95/96
2005/0042437 A1* 2/2005 Ramesh ..... C08J 9/0066 428/304.4
2009/0245562 A1* 10/2009 Saiki ..... H04R 1/2803 381/345

* cited by examiner

*Primary Examiner* — Yogeshkumar Patel
(74) *Attorney, Agent, or Firm* — IPro, PLLC; Na Xu

(57) ABSTRACT

An acoustic device includes a cabinet with a cavity room, a speaker unit mounted in the cavity room of the cabinet, a sealed room formed by the cabinet together with the speaker unit, a predetermined amount of nonpolarity gas which is sealed in the sealed room, a predetermined amount of zeolite absorbent which is sealed in the sealed room and physically absorbing the nonpolarity gas so as to decrease a resonant frequency of the sealed room and increase low frequency resonance of speaker unit.

3 Claims, 1 Drawing Sheet

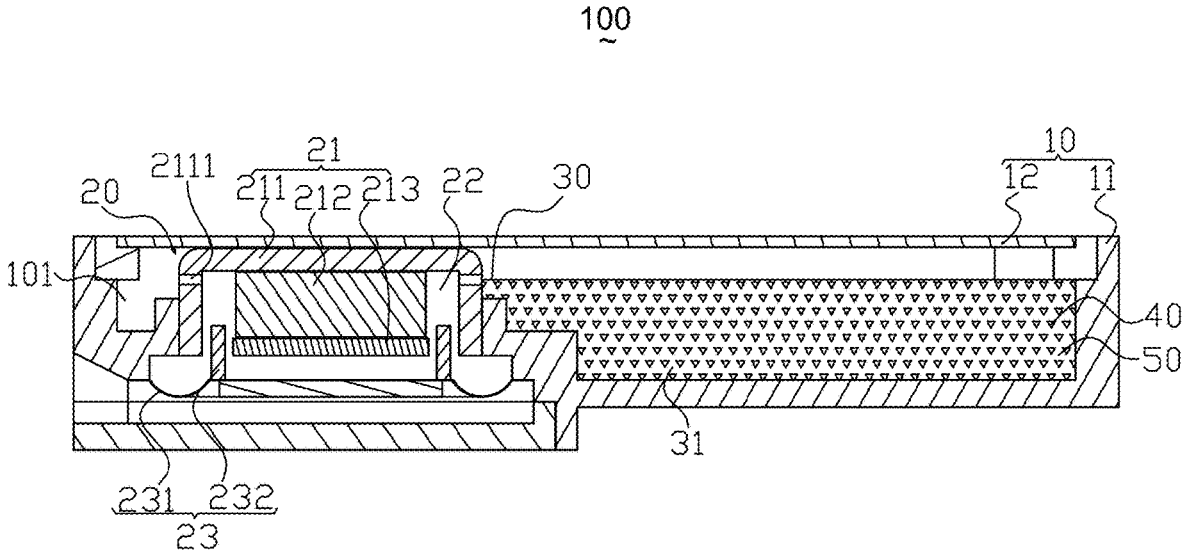
100
21
2111
211
212
213
22
30
20
10
12
11
101
40
50
31
231
232
23

ACOUSTIC DEVICE

RELATED PATENT APPLICATION

This application is a continuation of U.S. patent application Ser. No. 14/729,708, filed Jun. 3, 2015, which claims priority to Chinese Patent Application No. CN 201410245512.4, filed Jun. 4, 2014, the disclosures of which are incorporated in their entirety by reference herein.

FIELD OF THE INVENTION

The present disclosure relates to the art of speakers and, particularly to a speaker box provided with adsorbent for improving the low frequency performance.

DESCRIPTION OF RELATED ART

A loudspeaker device, including a loudspeaker, a housing and a resonance space, activated carbon or zeolite may be placed therein to improve sound generation of the loudspeaker device. An absorber in the resonance space of the loudspeaker leads to an apparent virtual enlargement of the resonance space by gas adsorption and desorption. The resonance frequency of the loudspeaker device is thereby lowered to a value that can be achieved without absorber only with an essentially larger resonance space.

However, it turned out that the use of absorbers results in several problems. One problem is the aging of the absorber in particular by irreversible adsorption of substances with high vapour pressure.

European Patent Publication EP 2 003 924 A1 relates to a loudspeaker system in which a gas absorber, obtained by adding a binder to a porous material including a plurality of grains so as to perform moulding, is used to physically adsorb gas in an enclosed space of the speaker system. The porous material may be made of one of the material selected from the group consisting of an activated carbon, zeolite, silica (SiO2), alumina (Al2O3), zirconia (ZrO3), magnesia (MgO), iron oxide black (Fe3O4) molecular sieve, fullerene and a carbon nanotube. The binder may be one of a powdery resin material and a fibrous resin material.

In addition, as the sound absorbing material, a rigid resin short tube made of polypropylene and the like can be used. A bag is filled with the rigid resin short tubes and is used as a pillow. A known speaker unit is packed with and surrounded by the pillow (for example, refer to Japanese Unexamined Patent Application Laid-Open No. 2002-281579).

Further, the speaker unit is accommodated inside the sound absorbing material. Thus, not only the sound wave, but also most high band sounds transmitted to a listener, is attenuated. Also, the sound absorbing material resonates with the sound wave of the particular frequency emitted from the front of the unit. Then, such a resonance is propagated as noise to the listener. Hence, high quality sound reproduction cannot be obtained.

In view of the above-described situation, there exists a need for an improved technique that enables to increase the virtual acoustic volume of a resonance space of a loudspeaker device while substantially avoiding or at least reducing one or more of the above-identified problems.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

FIG. 1 is a schematic cross-sectional view of an acoustic device in accordance with an exemplary embodiment of the present invention.

DETAILED DESCRIPTION OF THE EMBODIMENT

A speaker box in accordance with an exemplary embodiment of the present invention is used for converting audio electrical signals to audible sounds. The speaker box includes a cabinet, and a speaker unit attached to the cabinet. The speaker unit has a magnetic circuit, at least a vibrating unit corresponding to the magnetic circuit, at least a pair of welding pads for electrically connecting with the vibrating unit for conducting electrical signals to the vibrating units.

Referring to FIG. 1, an acoustic device 100, in accordance with an exemplary embodiment of the present disclosure, includes a cabinet 10 with a cavity room 101, a speaker unit 20 attached to the cabinet 10, a zeolite absorbent 40 and nonpolarity gas 50 located sufficiently in the inside of the cabinet 10.

Furthermore, the speaker unit 20 includes a magnetic circuit unit 21, and a vibrating unit 23 corresponding to the magnetic circuit unit 21. In the present embodiment, the magnetic circuit unit 21 has a yoke 211 mounted on the cabinet 10, a magnet 212, a hollow space 22 formed by the yoke 211 for accommodating the magnet 212 and the vibrating unit 23 therein, and a pole plate 213 mounted on the magnet 212. The vibrating unit 23 comprises a diaphragm 231, and a voice coil 232 connected directly or indirectly with the diaphragm 231 and actuated by the magnetic field of the magnetic circuit unit 21.

In additional, the cabinet 10 has a case 11 for fixing the speaker unit 20 in the cavity room 101 and a cover 12 cooperatively with the case 12. Specifically, the out periphery of the diaphragm 231 is supported by the case, the magnetic circuit unit 21 is positioned in the cavity room 101 for actuating the vibrating unit 23, and the cover 12 is attached to the case 11 along a direction far away from the diaphragm 231 for forming a sealed room 30 by the diaphragm 231 together with the cabinet 10. Certainly, the case 11 and the cover 12 as a whole receive the speaker unit 20.

It is well known that a micro-speaker generally has a leaking hole which is provided on a yoke or a case for receiving the yoke for balancing an internal acoustic pressure of the micro-speaker. Although illustration is not made, the speaker unit 20 has a leaking hole 2111 the same in the present embodiment. While the speaker unit 20 is received in the cabinet 10, the hollow space 22 of the magnetic circuit unit 21 communicates with the sealed room 30 through the leaking hole 2111. Therefore, the sealed room 30 is accordingly formed by the hollow space 22 cooperatively with a space 31 which is formed by the cabinet 10 together with the yoke 211.

A space 31 is formed by the cabinet 10 together with the speaker unit 20 that is filled with the zeolite absorbent 40. Furthermore, the nonpolarity gas 50 fills up the sealed room 30. While assembled, due to physical characteristic of the zeolite absorbent 40 and the nonpolarity gas 50, the sorption amount on the nonpolarity gas 50 is greater sharply than that of air so as to improve the low frequency resonance. In other words, the nonpolarity gas 50 can be easily absorbed by the zeolite absorbent 40, instead of air inside of the cabinet, it is easy to control characteristics of absorption and release of the absorbent. Accordingly, low-pitched sound reproduction capability of the speaker unit can be further enhanced.

The zeolite absorbent 40 may be, for example, 3A zeolite, 4A zeolite, 5A zeolite, 10X zeolite, 13X zeolite, Y zeolite, βzeolite, L zeolite, ZSM zeolite, and SBA zeolite. Alternatively, the adsorbent may comprise a combination of any of the above-mentioned, or any other, adsorbent materials. The nonpolarity gas 50 is gas sealed by the zeolite absorbent 40 in the sealed room 30 can physically absorb. Here, a suited gas is selected in consideration of a relationship between pore size distribution of a material of the zeolite absorbent 40 and sizes of molecules of the nonpolarity gas 50. Specifically, the nonpolarity gas 50 is carbon dioxide ($CO_2$), freon-12 (R12), ammonia ($NH_3$), sulfur dioxide ($SO_2$), methane ($CH_4$), propane ($C_3H_8$), butane ($C_4H_{10}$) or the like. In a words, the nonpolarity gas 50 is made of at least one selected from the group consisting of carbon dioxide ($CO_2$), freon-12 (R12), ammonia ($NH_3$), sulfur dioxide ($SO_2$), methane ($CH_4$), propane ($C_3H_8$), butane ($C_4H_{10}$). Alternatively, the nonpolarity gas 50 may comprise a combination of any of the above-mentioned. Even if the zeolite absorbent 40 is other material, these gases can be used as the nonpolarity gas 50.

As shown in the following table 1, these statistical data describe a adsorbance of the nonpolarity gas 50. According to actual requirement, the nonpolarity gas 50 may be a gas mixture of carbon dioxide ($CO_2$) and freon-12 (R12) at room temperature and atmospheric pressure.

TABLE 1

| Gas | Atmosphere Pressure (Pa) | Temperature(° C.) | Adsorbance(1/uc) |
|---|---|---|---|
| $CO_2$ | 866.6 | 18 | 10.7 |
| R12 | 399.9 | 20 | 9.8 |
| $NH_3$ | 799.9 | 18 | 13.6 |
| $SO_2$ | 533.3 | 22 | 15.3 |
| $CH_4$ | 866.6 | 18 | 5.4 |
| $C_3H_8$ | 866.6 | 18 | 11.15 |
| $C_4H_{10}$ | 799.9 | 18 | 10.8 |
| Air | 866.6 | 18 | 1.6 |

Generally, a cavity has a compliance $C_a$ obtained by the following formula:

$$C_a = V/\rho c^2.$$

Here, V is the volume of the cavity, ρ is the density of gas, C is sound velocity of gas. In an exemplary embodiment, while the gas mixture of carbon dioxide ($CO_2$) and freon-12 (R12) displaces the air filled in the acoustic device 100, the compliance of the acoustic device 100 is greatly improved so as to reduce a resistance of the diaphragm of the speaker unit, and decrease a resonant frequency of the sealed room and increase low frequency resonance in the same time.

While the present invention has been described with reference to a specific embodiment, the description of the invention is illustrative and is not to be construed as limiting the invention. Various of modifications to the present invention can be made to the exemplary embodiment by those skilled in the art without departing from the true spirit and scope of the invention as defined by the appended claims.

What is claimed is:

1. An acoustic device, comprising:

a cabinet defining a cavity room;

a speaker unit mounted in the cavity room of the cabinet and having a diaphragm;

a sealed room formed by the cabinet cooperatively with the diaphragm of the speaker unit, the sealed room comprising an internal space within the speaker unit and an external space out of the speaker unit formed by the cabinet together with the speaker unit and communicating with the internal space;

a predetermined amount of gas sealed in the sealed room, the predetermined amount of gas selected from at least one of sulfur dioxide ($SO_2$), methane ($CH_4$), propane ($C_3H_8$), butane ($C_4H_{10}$);

a predetermined amount of zeolite absorbent filled in the external space for physically absorbing at least part of the predetermined amount of gas for reducing a resistance of the diaphragm of the speaker unit, decreasing a resonant frequency of the sealed room, and increasing a low frequency resonance of the acoustic device.

2. The acoustic device as claimed in claim 1, wherein the predetermined amount of gas is sulfur dioxide ($SO_2$).

3. The acoustic device as claimed in claim 1, wherein the predetermined amount of zeolite absorbent is made of one of the materials selected from 3A zeolite, 4A zeolite, 5A zeolite, 10X zeolite, 13X zeolite, Y zeolite, βzeolite, L zeolite, ZSM zeolite, and SBA zeolite.

* * * * *